US007076979B2

(12) United States Patent
Wilhelm et al.

(10) Patent No.: US 7,076,979 B2
(45) Date of Patent: Jul. 18, 2006

(54) METHOD AND DEVICE FOR PRODUCING CURVED LENGTHS OF SPRING BAND STEEL

(75) Inventors: Manfred Wilhelm, Eberdingen (DE); Thomas Blum, Eningen (DE); Julius Mazurkiewicz, Diest (BE); Theo Troester, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 430 days.

(21) Appl. No.: 10/052,937

(22) Filed: Oct. 22, 2001

(65) Prior Publication Data

US 2002/0116973 A1 Aug. 29, 2002

Related U.S. Application Data

(63) Continuation-in-part of application No. 09/647,770, filed on Oct. 6, 2000, now abandoned.

(30) Foreign Application Priority Data

Apr. 7, 1998 (DE) ..... 198 15 529

(51) Int. Cl.
*B21D 7/12* (2006.01)
*B21D 7/08* (2006.01)

(52) U.S. Cl. ..... 72/11.8; 72/11.1; 72/12.7; 72/9.2; 72/7.6; 72/173; 72/129

(58) Field of Classification Search ..... 72/169, 72/171, 173, 166, 129, 130, 7.6, 8.9, 9.2, 72/11.6, 11.8, 12.7, 12.8
See application file for complete search history.

(56) References Cited

U.S. PATENT DOCUMENTS

| | | | | | |
|---|---|---|---|---|---|
| 1,489,894 | A | * | 4/1924 | Monteith | 72/171 |
| 2,288,920 | A | * | 7/1942 | Ronksley | 72/19.6 |
| 3,395,846 | A | * | 8/1968 | Mille | 228/5.1 |
| 4,367,641 | A | | 1/1983 | Mizutani | |
| 4,391,116 | A | | 7/1983 | Yogo | |
| 4,412,438 | A | * | 11/1983 | Tjushevsky et al. | 72/11.1 |
| 4,532,794 | A | | 8/1985 | Mauderer | |
| 4,549,422 | A | * | 10/1985 | Harrow | 72/131 |
| 4,918,958 | A | * | 4/1990 | Glomb et al. | 72/12.7 |
| 5,010,756 | A | | 4/1991 | Node et al. | |
| 5,485,650 | A | | 1/1996 | Swanepoel | |
| 5,590,556 | A | | 1/1997 | Fourie et al. | |
| 5,855,133 | A | | 1/1999 | Hayes | |
| 5,875,672 | A | | 3/1999 | Fourie et al. | |
| 6,167,607 | B1 | | 1/2001 | Pryor | |

FOREIGN PATENT DOCUMENTS

| | | | | |
|---|---|---|---|---|
| BE | 555774 | * | 2/1960 | 72/173 |
| CH | 202717 | * | 3/1966 | 72/171 |
| GB | 743485 | * | 1/1956 | 72/173 |
| JP | 189826 | * | 8/1986 | 72/171 |
| NL | 7807040 | * | 1/1980 | 72/171 |
| SU | 0640798 | * | 1/1979 | 72/173 |

* cited by examiner

*Primary Examiner*—Daniel C. Crane
(74) *Attorney, Agent, or Firm*—Michael J. Striker

(57) ABSTRACT

In a method and a device for producing curved lengths of spring band steel in order to produce precisely toleranced, dimensionally stable bending radii, the spring band steel (10) pass through a bending unit (20), which is comprised of three support points (23–25) spaced apart from one another, and passes through a reverse bending unit (22), which is disposed after the bending unit (20) in the advancing direction of the spring band steel (10) and is comprised of a fourth support point (32), and in a cutting unit (21), the curved and recurved lengths of spring band steel (11) are cut from the spring band steel (10). The central support point (24) of the bending unit (20) and the fourth support point (32) of the reverse bending unit (22) are embodied so that they can be moved and are controlled in their advancing in relation to the spring band steel (10) by means of a numerical control unit (20) in accordance with predetermined programs (FIG. 1).

36 Claims, 1 Drawing Sheet

METHOD AND DEVICE FOR PRODUCING CURVED LENGTHS OF SPRING BAND STEEL

CROSS-REFERENCE TO A RELATED APPLICATION

This application is a continuation-in-part of application Ser. No. 09/647,770 filed Oct. 6, 2000, now abandoned.

BACKGROUND OF THE INVENTION

The invention relates to a method and a device for producing curved lengths of spring band steel.

WO 94/17932 has disclosed a method and a device for producing metal strips. With this method and device, band material of constant thickness and width is drawn by a pair of opposing rollers and the distance between the rollers is varied in order to shape the band material so that it has a varying thickness over its length and the band material is then subjected to a heat treatment.

SUMMARY OF THE INVENTION

The method according to the invention and the device according to the invention for producing curved lengths of spring band steel, have the advantage that in a single process cycle, which corresponds to one pass th rough the device, lengths of spring band steel are produced from a band material blank. The bending and reverse bending takes place through continuous advancing of the spring band steel, while a short transport stop is inserted for cutting the lengths of spring band steel. The finished lengths of spring band steel are manufactured to precise tolerances with the predetermined bending radii and are absolutely dimensionally stable as a result of the reverse bending. Because of the mobility of the center support point of the bending unit, which support point is preferably embodied in the form of rollers, and of the support point of the reverse bending unit, whose advancing in relation to the spring band steel is numerically controlled, the varying material thickness is taken into account and the spring band steel is plastically deformed uniformly in all regions. At the same time, various bending radii can be produced within one length of spring band steel. The numerical control is achieved by means of predetermined programs which take into account the material thickness and material width of the spring band steel that change with the advancing feed, the desired bending radii of the lengths of spring band steel, as well as other parameters that influence manufacturing results, such as band hardness, prior alignment of the spring band steel, winding direction of the spring band steel on a storage spool, etc.

According to a preferred embodiment of the invention, the cutting unit is integrated into the bending unit, which is realized by virtue of the fact that the last support point of the bending unit in the spring band steel advancing direction is embodied as a cutting edge extending over the maximal spring band steel width, which a cutting blade is guided past, moving lateral to the spring band steel. This integration of the cutting unit and bending unit saves on components and the device becomes more reasonably priced and more compact for technical manufacturing reasons.

According to an advantageous embodiment of the invention, a program for the bending, reverse bending, and cutting of the lengths of spring band steel from the spring band steel is initiated by means of so-called trigger holes, which are provided in the spring band steel between the individual lengths of spring band steel and whose entry into the bending unit is sensed and causes the triggering of the numerical control. In lieu of the trigger holes, a band thickness measurement can also be provided, which executes the triggering of the numerical control depending on the detection of a particular band thickness.

In order to maintain extremely high manufacturing tolerances, according to an advantageous embodiment of the invention, a correcting device is provided, which is combined with an image capturing system and corrects the program for the numerical control of the bending and/or reverse bending unit as function of deviations from reference values. The reference value deviations are detected by means of the image capturing system, which optically measures at least part of the finished lengths of spring band steel and compares it to a reference value.

According to an advantageous embodiment of the invention, the spring band steel is supplied by means of two driven advancing rollers on opposite sides of the spring band steel which takes the spring band steel from a storage roll and supply it to the bending unit. In order to prevent a buckling of the spring band steel in the course of this, according to another embodiment of the invention, a tight band guidance between the advancing rollers and the bending unit is assured by means of a number of guide rollers and/or guide rails.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The invention is explained in detail in the description below in conjunction with an exemplary embodiment of a device depicted in the drawings.

DESCRIPTION OF THE PREFERRED EMBODIMENTS

Figures 1, 2, 3:
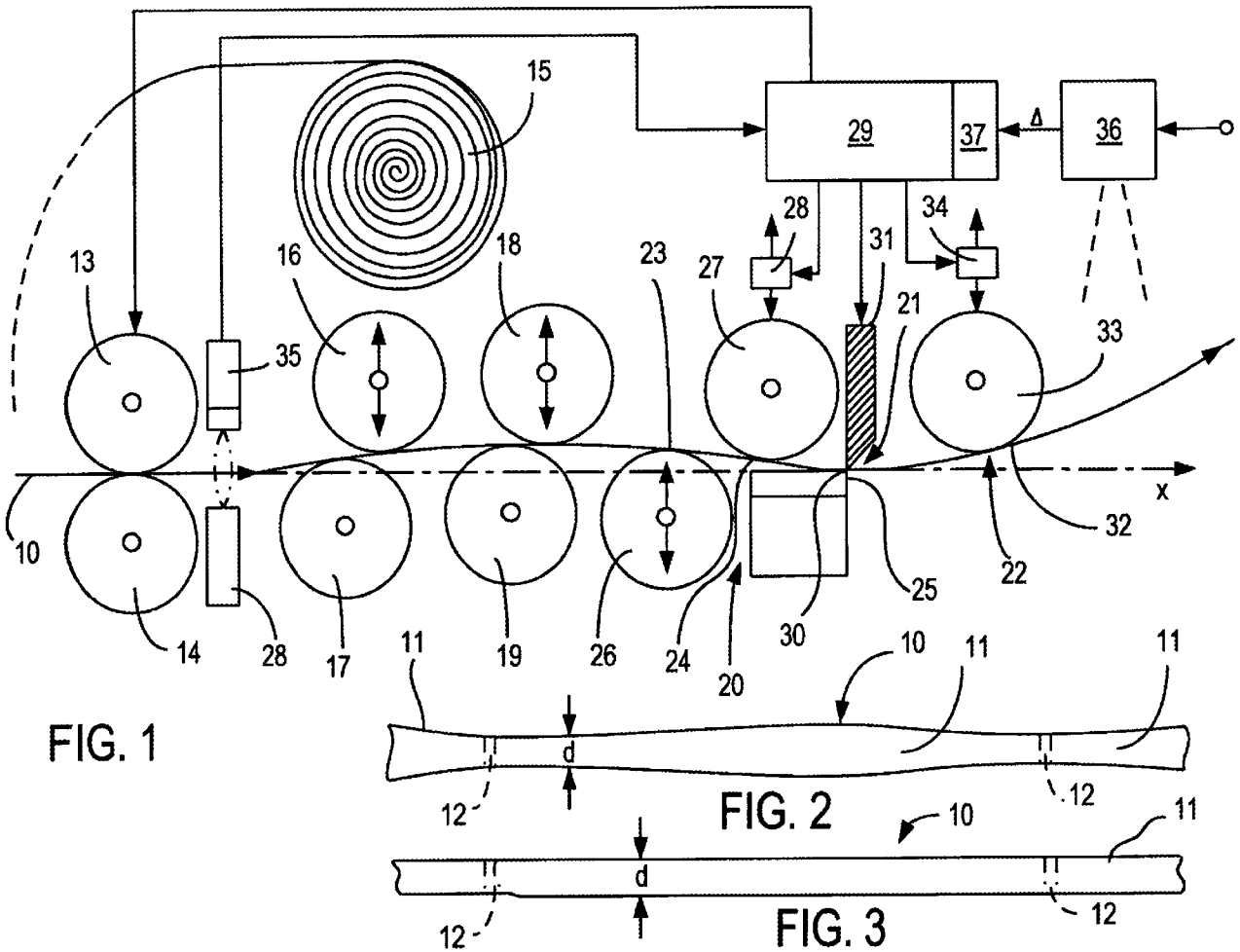
FIG. 1 is a schematic side view of a device for producing curved lengths of spring band steel.
FIG. 2 shows a schematic detail of an enlarged side view of a spring band steel, which has a variable material thickness and is used for the production of the curved lengths of spring band steel.
FIG. 3 shows a schematic detail of an enlarged side view of spring band steel which has a constant material thickness and is used for the production of the lengths of spring band steel.

The device for producing curved lengths of spring band steel, which is schematically depicted in a side view in FIG. 1, is supplied with a spring band steel 10, an enlarged detail of which is schematically depicted in FIG. 2. Individual, homogenous lengths of spring band steel 11 are continuously fixed one after another in the spring band steel 10 and their beginnings and ends are marked by so-called trigger holes 12 in the spring band steel 10. Within each length of spring band steel 11, the material thickness or band thickness d of the spring band steel 10 varies, as shown in FIG. 2. In a realistic exemplary embodiment, the band thickness d fluctuates between the maximal value of 1.2 mm and in minimal value of 0.4 mm, where the band thickness d decreases from the center of a length of spring band steel 11 towards its end.

In accordance with another embodiment of the invention, within each length of spring band steel 11, the material thickness or band thickness d of the spring band steel 10 does not vary or in other words is constant as shown in FIG. 3.

The device has one or two pairs of advancing rollers 13, 14—which are disposed one after the other in the travel direction or advancing direction of the spring band steel, engage opposite band sides of the spring band steel 10, are driven by motor, are numerically controlled, and take the spring band steel 10 from a storage roll 15—, has a number of guide rollers 16–19, four in this case but possibly also six, which engage in pairs on opposite band sides of the spring band steel 10 and are not driven, and has a bending unit 20, a cutting unit 21, and a reverse bending unit 22. The two guide rollers 16, 18 engaging the top of the spring band steel 10 are embodied so that they can be moved in the vertical direction, i.e. at right angles to the spring band steel 10, and can be manually adjusted in order to assure a tight guidance of the spring band steel 10 without the possibility of buckling. In lieu of or in addition to the guide rollers 16–19, guide rails can also be provided, which likewise rest in pairs against opposite band sides of the spring band steel 10.

The bending unit 20 contains three support points 23–25 spaced apart from one another, which alternatingly rest against different band sides one after the other in the travel direction of the spring band steel 10. The first and second support points 23, 24 in terms of the advancing direction of the spring band steel 10 are each constituted by the circumference of a roller 26 & 27 and their axes are embodied so that they can be moved lateral to the spring band steel 10 in the direction of the band thickness d. The first roller 26 can be manually adjusted while the adjustment of the second roller 27, referred to below as the bending roller 27, is executed by an adjusting motor 28, which is controlled by a numerical control unit 29. The third support point 25 of the bending unit 20 is constituted by a cutting edge 30, which is greater than the width of the spring band steel 10 and cooperates with a cutting blade 31 in order to cut a length of spring band steel 11, which blade moves vertically, i.e. lateral to the spring band steel 10, and is conveyed past the cutting edge 30. The cutting edge 30 and cutting blade 31 constitute the cutting unit 21, which is thus disposed at the end of the bending unit 20 and is integrated into the bending unit 20 through the design of the fourth support point 25 as a cutting edge 30.

The reverse bending unit 22 disposed after the cutting unit 21 is comprised of a fourth support point 32, which engages the same band side of the spring band steel 10 as the center support point 24 of the bending unit 20, i.e. the same side as the bending roller 27, and in this case as well, this fourth support point 32 is constituted by the circumference of a roller, the so-called reverse bending roller 33. The roller axis of the reverse bending roller 33 is likewise embodied so that it can be moved lateral to the spring band steel 10 in the direction of the band thickness d. The movement of the reverse bending roller 33, the so-called advancing, is in turn produced by means of an adjusting motor 34 which is controlled by the numerical control unit 29.

The numerical control unit 29 that controls the adjusting motors 28, 34 of the bending roller 27 and the reverse bending roller 33 operates in accordance with predetermined programs which take into account both the varying material thickness d or the constant material thickness d and the material width of the length of spring band steel 11 as well as possibly desired zonally varying bending radii of the length of spring band steel 11 is intended to be curved with varying bending radii or maintained straight. For example, such a length of spring band steel 11 can have a large bending radius in the center and two smaller bending radii with an opposite bending direction disposed close to its ends. These programs used on the length of spring band steel 11 are activated by means of the trigger holes 12 disposed in the sprint band steel 10, between the individual lengths of spring band steel 11. The trigger holes 12 are detected by an optical sensor 35, which cooperates with a light source 38 and is disposed before the guide rollers 16–19, and as a result of this detection, this optical sensor 35 sensor sends a trigger signal to the control unit 29 and thus activates the program. In this connection, the advancing movement of the bending roller 27 is greater than is necessary for the desired bending radius of the length of spring band steel 11. The length of spring band steel 11 is then bent back by this mount in the reverse bending unit 22 by means of a corresponding advancing of the reverse bending roller 33 in the opposite direction. The reverse bending degree that is required to assure the dimensional stability of the curved length of spring band steel 11 is empirically determined. A reverse bending degree of 10–20% of the bending degree produced in the bending unit 20 has turned out to be advantageous, depending on the quality of the spring band steel 10. Since the bending radius of the finished length of spring band steel 11 is predetermined, consequently the advancing movement of the bending roller 27 is programmed so that a bending degree of the length of spring band steel 11 is produced which is greater by the reverse bending degree. The bending and reverse bending of the individual lengths of spring band steel 11 in the spring band steel 10 occurs with continuous advancing movement of the spring band steel 10. In order to cut the finished length of spring band steel 11 from the spring band steel 10 by means of the cutting unit 21 which is also controlled by the numerical control unit 29, the band transport is stopped for short time.

In order to achieve tighter manufacturing tolerances, an image capturing system 36 is provided, with which at least part of the finished lengths of spring band steel 11 can be optically measured and deviations from a present reference value can be detected. The average reference value deviations are supplied to a correcting device 37, which changes corresponding parameters in the programs of the numerical control unit 29 so that a control loop for correcting the bending degree is produced. In addition to the variable material thickness and the possibly zonally varying predetermined bending radii, the bending and reverse bending programs stored in the numerical control unit 29 also take into account other parameters which influence the bending result, i.e. the band width, the band hardness, a possible prior alignment, the winding direction of the spring band steel 10 on the storage roll 15, etc. The stored programs are matched to a particular form of the finished lengths of spring band steel 11 and must be rewritten or correspondingly modified for altered forms of the lengths of spring band steel 11.

It will be understood that each of the elements described above, or two or more together, may also find a useful application in other types of methods and constructions differing from the types described above.

While the invention has been illustrated and described as embodied in method and device for producing curved lengths of spring band steel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing curved lengths of spring bend band steel, comprising the steps of bending a spring band steel (10) which is made up of lengths of spring band steel (11) that adjoin one another and are of one piece with one another, between three support points (23–25), which are spaced from each other in a spring band steel advancing direction and rest against alternating band sides of the spring band steel (10); at a subsequent support point (32) downstream of the three support points (23–25), bending back by a lesser bending degree than during the bending by the three support points (23–25) in an opposite direction, cutting the length of spring band steel (11) that is bent from the spring band steel (10); establishing the subsequent support point as a movable reverse bending roller (33); and controlling a movement of the reverse bending roller (33) by a numerical control unit (29).

2. A method as defined in claim 1; and further comprising constituting other support points (23, 24, 32) by a circumference of a roller (26, 27, 33).

3. A method as defined in claim 1; and further comprising setting the bending degree of the spring band steel (10) in the three support points (23–25) to be greater by the reverse bending degree at a fourth support point (32) than a required final bending radius of the length of spring band steel (11).

4. A method as defined in claim 1; and further comprising empirically determining the reverse bending degree.

5. A method as defined in claim 1; and further comprising providing a reverse bending degree to be 10–20% of a bending degree.

6. A method as defined in claim 1 and further comprising carrying the bending and reverse bending of the spring band steel (10), with continuous advancing of the spring band steel which is temporarily interrupted for the cutting of the lengths of the spring band steel (11).

7. A method of producing curved lengths of spring bend band steel, comprising the steps of bending a spring band steel (10) which is made up of lengths of spring band steel (11) that adjoin one another and are of one piece with one another, between three support points (23-25) ,which are spaced from each other in a spring band steel advancing direction and rest against alternating band sides of the spring band steel (10); at a subsequent support point (32) downstream of the three support points (23-25), bending back by a lesser bending degree than during the bending by the three support points (23-25) in an opposite direction; cutting the length of spring band steel (11) that is bent from the spring band steel (10); marking the adjoining lengths of spring band steel (11) by trigger holes (12) for controlling beginnings and ends of the bending step, the bending back step and the cutting step.

8. A method as defined in claim 7; and further comprising constituting the other support points (23, 24, 32) by a circumference of a railer (26, 27, 33)

9. A method as defined in claim 7; and further comprising setting the bending degree of the spring band steel (10) in the three support points (23-25) to be greater by the reverse bending degree at the fourth support point (32) than a required final bending radius of the length of spring band steel (11).

10. A method as defined in claim 7 and further comprising empirically determining the reverse bending degree.

11. A method as defined in claim 7; and further comprising providing the reverse bending degree to be 10–20 % of the bending degree.

12. A method as defined in claim 7; further comprising carrying the bending and reverse bending of the spring bend steel (10), with continuous advancing of the spring band steel which is temporarily interrupted for the cutting of the lengths of the spring

13. A device for producing curved lengths of spring band steel (11), comprising a bending unit (20) including three support points (23-25) spaced apart from one another; means for conveying there through spring band steel (10) which is made of lengths of spring band steel (11) that are disposed after one another and are of one piece with one another so that the support points (23-25) rest against alternating band sides of the spring band steel, wherein the center support point (24) of the three support points (23-25) is embodied so that it is movable lateral to the spring band steel in order to adjust the banding radius; a reverse bending unit (22) that engages the same band side of the spring band steel (10) as the center support point (24) of the three support points (23-25) of the bending unit (20) and having a support point (32), the reverse bending unit is movable lateral to the spring band steel in order to adjust a reverse banding radius by means of numerical control unit (29); and a cutting unit (21) for cutting the length of the spring band steel (11) which passes through the bending unit (20) and the reverse bending unit (22).

14. A device as defined in claim 13, wherein the adjusting movements of the central support point (24) of the bending unit (20) and the support point (32) of the reverse bending unit (22) are controlled by means of a control unit (29) in accordance with programs which take into account the varying material thickness and the possibly varying, predetermined zonal bending radii of the lengths of spring band steel (11).

15. A device as defined in claim 14, wherein the lengths of spring band steel (11) following one after the other in the spring band steel (10) are marked by means of trigger holes (12) in the spring band steel (10) which are used to trigger the control unit (29) in order to begin and end the bending and reverse bending programs and to trigger the cutting process by means of the cutting unit (21).

16. A device as defined in claim 14, wherein the programmed adjusting movement of the central support point (24) of the bending unit (20) and the programmed adjusting movement of the support point (32) of the reverse bending unit (22) are matched to each other so that the bending degree produced in the bending unit (20) is greater by the reverse bending degree than the predetermined final bending degree of the length of spring band steel (11).

17. A device as defined in claim 16, wherein the magnitude of the reverse bending degree is empirically determined.

18. A device as defined in claim 16, wherein the reverse bending degree is selected to be 10–20 % of the bending degree.

19. A device as defined in claim 13, wherein the spring band steel (10) is wound on a storage roll (15) and that the spring band steel (10) is conveyed between at least two driven advancing rollers (13, 14), which engage opposite band sides of the spring band steel (10), take the spring band steel (10) from the storage roll (15), and supply it tot he bending unit (20).

20. A device as defined in claim 13, wherein a number of rollers selected from the group consisting of guide rollers (16-19) and guide rails are disposed ahead of the bending unit (20) and rest in pairs against opposite sides of the spring band steel (10).

21. A device for reproducing curved lengths of spring band steel (11), comprising bending unit 120) including three support points (23-25) spaced apart from one another through which a spring band steel (10) which is made of the length of spring band steel (11) that are disposed one another and are of one piece with one another is conveyable so that the support points 23-25 rest against alternating band sides of the spring band steel, wherein the center support point (24) of the three support points (23-25) is embodied so that it is movable lateral to the spring band steel in order to adjust the banding radius; a reverse bending unit (22) that engages the same band side of the spring band steel (10) as the center support point (24) of the three support points (23-25) of the bending unit (20) and having a support point (32), the reverse bendino unit is movable lateral to the spring band steel in order to adjust a reverse banding radius by means of numerical control unit (29); and a cutting unit (21) for cutting the length of the spring band steel (11) which passes through the bending unit (20) and the reverse bending unit (22), wherein the cutting unit (21) is integrated into the bending unit (20) by virtue of the fact that the last support point (25) of the bending unit (20) in the advancing direction of the spring band steel is embodied as a cutting edge (30) extending over the width of the spring band steel, which a cutting blade (31) is guided past, moving lateral to the spring band steel (10).

22. A device as defined in claim 21, wherein the first support point (23) of the bending unit (20) in the advancing direction of the spring band steel (10) is embodied so that it can be moved, preferably manually, lateral to the spring band steel (10) in the direction of the band thickness.

23. A device as defined in claim 21, wherein the two support points (23, 24) of the bending unit (20) and the support point (32) of the reverse bending unit (22) are constituted by the circumference of rollers (26, 27, and 33).

24. A device for producing curved lengths of spring band steel (11), comprising a bending unit (20) including three support points (23-25) spaced apart from one another through which a spring band steel (10) which is made of the length of spring band steel (11) that are disposed one another and are of one piece with one another, is conveyable so that the support points (23-25) rest against alternating band sides of the spring band steel, where the center support point (24) of the three support points (23-25) is embodied so that it is movable lateral to the spring band steel in order to adjust the banding radius; a reverse bending unit (22) that engages the same band side of the spring band steel (10) as the center support point (24) of the three support points (23-25) of the bending unit (20) and having a support point (32), the reverse bending unit is movable lateral to the spring band steel in order to adjust a reverse banding radius by means of numerical control unit (29); and a cutting unit (21) for cutting the length of the spring band steel (11) which passes through the bending unit (20) and the reverse bending unit (22), wherein the adjusting movements of the central support point (24) of the bending unit (2O) and the support point (32) of the reverse bending unit (22) are controlled by means of a control unit (29) in accordance with programs which take into account the varying material thickness and the possibly varying, predetermined zonal bending radii of the lengths of spring band steel (11), wherein an image capturing system (36) is provided for optically measuring the finished lengths of spring band steel (11) cut from the spring band steel (10) and determining the deviation from a preset reference value, and by means of a correcting device (37) for correcting the bending and/or reverse bending program as a function of an average reference value deviation.

25. A device for producing curved lengths of spring band steel (11), comprising a bending unit (20) including three support points (23-25) spaced apart from one another through which a spring band steel (10) which is made of the lengths of spring band steel (11) that adjoin one another and are of one piece with one another, is conveyable so that the support pointS (23-25) rest against alternating band sides of the spring band steel, wherein the center support point (24) of the three support points (23-25) is embodied so that it is movable lateral to the spring band steel in order to adjust the banding radius; a reverse bending unit (22) that engages the same band side of the spring band steel (10) as the center support point (24) of the three support points (23-25) of the bending unit (20) and having a support point (32); a cutting unit (21) for cutting the length of spring band steel (11) passing through the bending and reverse band unit (20, 22); marking the length of spring band steel (11) in the spring band (10) by trigger holes (12) for triggering a control unit (29) for beginning and ending bending with the bending unit (20) and reverse bending with the reverse bending unit (22) and for beginning cutting with the cutting unit (21).

26. A device as defined in claim 25, wherein the adjusting movements of the central support point (24) of the bending unit (20) and the support point (32) of the reverse bending unit (22) are controlled by means of a control unit (29) in accordance with programs which take into account the varying material thickness and the possibly varying, predetermined zonal bending radii of the lengths of spring band steel (11).

27. A device as defined in claim 26, wherein the lengths of spring band steel (11) following one after the other in the spring band steel (10) are marked by means of trigger holes (12) in the spring band steel (10) which are used to trigger the control unit (29) in order to begin and end the bending and reverse bending programs and to trigger the cutting process by means of the cutting unit (21).

28. A device as defined in claim 26, wherein the programmed adjusting movement of the central support point (24) of the bending unit (20) and the programmed adjusting movement of the support point (32) of the reverse bending unit (22) are matched to each other so that the bending degree produced in the bending unit (20) is greater by the reverse bending degree than the predetermined final bending degree of the length of spring band steel (11).

29. A device as defined in claim 28, wherein the magnitude of the reverse bending degree is empirically determined.

30. A device as defined in claim 28, wherein the reverse bending degree is selected to be 10–20 % of the bending degree.

31. A device as defined in claim 25, wherein the spring band steel (10) is wound on a storage roll (15) and that the spring band steel (10) is conveyed between at least two driven advancing rollers (13, 14), which engage opposite band sides of the spring band steel (10), take the spring band steel (10) from the storage roll (15), and supply it to the bending unit (20).

32. A device as defined in claim 25, wherein a number of rollers selected from the group consisting of guide rollers (16-19) and guide rails are disposed ahead of the bending unit (20) and rest in pairs against opposite sides of the spring band steel (10).

33. A device for producing curved lengths of spring band steel (11), comprising a bending unit (20) including three support points (23-25) spaced apart from one another through which a spring band steel (1O) which is made of the lengths of spring band steel (11) that adjoin one another and are of one piece with one another, is conveyable so that the support points (23-25) rest against alternating band sides of the spring band steel, wherein the center support point (24) of the three support points (23-25) is embodied so that it is movable lateral to the spring band steel in order to adjust the banding radius; a reverse bending unit (22) that engages the same band side of the spring band steel (10) as the center support point (24) of the three support points (23-25) of the bending unit (2O) and having a support point (32); a cutting unit (21) for cutting the length of spring band steel (11) passing through the bending and reverse band unit (20, 22); marking the length of spring band steel (11) in the spring band (10) by trigger holes (12) for triggering a control unit (29) for beginning and ending bending with the bending unit (20) and reverse bending with the reverse bending unit (22) and for beginning cutting with the cutting unit (21), wherein the cutting unit (21) is integrated into the bending unit (20) by virtue of the fact that the last support point (25) of the bending unit (20) in the advancing direction of the spring band steel is embodied as a cutting edge (30) extending over the width of the spring band steel, which a cutting blade (31) is guided past, moving lateral to the spring band steel (10).

34. A device as defined in claim 33, wherein the first support point (23) of the bending unit (20) in the advancing direction of the spring band steel (10) is embodied so that it can be moved, preferably manually, lateral to the spring band steel (10) in the direction of the band thickness.

35. A device as defined in claim 33, wherein the two support points (23, 24) of the bending unit (20) and the support point (32) of the reverse bending unit (22) are constituted by the circumference of rollers (26, 27, and 33).

36. A device for producing curved lengths of spring band steel (11), comprising a bending unit (20) including three support points (23-25) spaced apart from one another through which a spring band steel (10) which is made of the lengths of spring band steel (11) that adjoin one another and are of one piece with one another, is conveyable so that the support points (23-25) rest against alternating band sides of the spring band steel, wherein the center support point (24) of the three support points (23-25) is embodied so that it is movable lateral to the spring band steel in order to adjust the banding radius; a reverse bending unit (22) that engages the same band side of the spring band steel (10) as the center support point (24) of the three support points (23-25) of the bending unit (20) and having support point (32); a cutting unit (21) for cutting the length of spring band steel (11) passing through the bending and reverse band (2O, 22); marking the length of spring band steel (11) in the spring band (10) by trigger holes (12) for triggering a control unit (29) for beginning and ending with the bending unit (20) and reverse bending with the reverse bending unit (22) and for beginning cutting with the cutting unit (21), wherein the adjusting movements of the central support point (24) of the bending unit (20) and the support point (32) of the reverse bending unit (22) are controlled by means of a control unit (29) in accordance with programs which take into account the varying material thickness and the possibly varying, predetermined zonal bending radii of the lengths of spring band steel (11), wherein an image capturing system (36) is provided for optically measuring the finished lengths of spring band steel (11) cut from the spring band steel (10) and determining the deviation from a preset reference value, and by means of a correcting device (37) for correcting the bending and/or reverse bending program as a function of an average reference value deviation.

* * * * *